US007316489B2

(12) United States Patent
Chou

(10) Patent No.: US 7,316,489 B2
(45) Date of Patent: Jan. 8, 2008

(54) SECTIONAL LIGHTING FIXTURE STRUCTURE

(76) Inventor: Tsung Yuan Chou, No. 3, Lane 328, Sec. 3, Chung-Hsin Rd., Chutung, Hsinchu (TW)

( * ) Notice: Subject to any disclaimer, the term of this patent is extended or adjusted under 35 U.S.C. 154(b) by 6 days.

(21) Appl. No.: 11/154,689

(22) Filed: Jun. 17, 2005

(65) Prior Publication Data

US 2006/0285319 A1 Dec. 21, 2006

(51) Int. Cl.
*F21V 29/00* (2006.01)

(52) U.S. Cl. ..... 362/373; 362/148; 362/162; 362/178; 362/208

(58) Field of Classification Search ..... 362/373, 362/148, 162, 171, 178, 202, 208, 189, 197, 362/294, 418
See application file for complete search history.

(56) References Cited

U.S. PATENT DOCUMENTS 2,510,812 A * 6/1950 Garland et al. ..... 248/685
4,495,550 A * 1/1985 Visciano ..... 362/189
5,630,661 A * 5/1997 Fox ..... 362/187
5,826,972 A * 10/1998 Chiu ..... 362/188
5,951,153 A * 9/1999 Favela ..... 362/414
2005/0024864 A1* 2/2005 Galli ..... 362/202

* cited by examiner

*Primary Examiner*—Sandra O'Shea
*Assistant Examiner*—Mark Tsidulko
(74) *Attorney, Agent, or Firm*—Bacon & Thomas, PLLC

(57) ABSTRACT

A sectional lighting fixture structure includes a hollow main body, an end cap connected to and closing a rear open end of the main body, a socket connected to an inner side of a front open end of the main body for a bulb to mount thereto, and a lighting lampshade externally connected to the front open end of the main body. The main body is a lightweight metal cylindrical body having been subjected to expansion process to include two straight walls at the front and rear ends, and a middle portion having a plurality of bellow expansion joints that provides the main body with good pressure resistance. The socket is in the form of a heat-resistant insulating wool, so that heat produced by the bulb mounted thereto is not transmitted to the main body to adversely affect a normal temperature of a ballast mounted in the main body.

4 Claims, 5 Drawing Sheets

SECTIONAL LIGHTING FIXTURE STRUCTURE

FIELD OF THE INVENTION

The present invention relates to a lighting fixture structure, and more particularly to a sectional lighting fixture structure that is easy to assemble and includes a main body made of a thin metal material and subjected to expansion process to provide good heat resistance and heat radiating ability as well as high pressure strength.

BACKGROUND OF THE INVENTION

Most conventional lighting fixtures, such as the pendant and the ceiling lighting fixture shown in FIGS. 5 and 6, respectively, have a main body made of a metal material, such as aluminum alloy, aluminum, copper, iron, steel, etc. It is known that metals have relatively high density. When the metal main bodies of the conventional lighting fixtures have an increased wall thickness, the lighting fixtures would have a largely increased overall weight.

Meanwhile, to enable a stable use of the lighting fixture, most lighting fixtures would have a ballast mounted therein. The ballast internally includes a heavy transformer, which endangers the wall strength of the lighting fixture main body. To ensure a sufficient pressure strength, the conventional lighting fixture main bodies made of aluminum alloy, extruded aluminum, or even die-cast aluminum usually have a wall thickness more than 2 mm, resulting in increased overall volume and weight of the completed lighting fixtures and preventing the lighting fixtures from convenient use thereof. As to other types of metal materials, they are difficult to machine or process, and therefore require high manufacturing cost.

While a plastic material may be used to overcome the difficulties in forming the lighting fixture main bodies with metal materials, the plastic material has poor heat resistance and heat radiating ability to cause problems in the safety use of the heat-producing lighting fixtures. That is why most lighting fixtures, particularly the high bay and the ceiling lighting fixtures, do not use plastic materials to form the main bodies thereof.

As a result, most currently commercially available lighting fixtures, particularly high bay and ceiling lighting fixtures, are bulky, uneasy to assemble, and expensive due to high manufacturing cost thereof. Moreover, the biggest problem with the main bodies of the conventional lighting fixtures is they do not include any reinforcing structure to provide sufficient pressure strength.

It is therefore tried by the inventor to develop an improved lighting fixture structure to overcome the problems existed in the conventional lighting fixtures.

SUMMARY OF THE INVENTION

A primary object of the present invention is to provide a sectional lighting fixture structure that can be easily manufactured and assembled, and includes a main body made of a sheet metal material to largely reduce an overall weight of the lighting fixture and provide good heat resistance and heat radiating ability.

Another object of the present invention is to provide a sectional lighting fixture structure that includes a main body having high pressure strength and not subjected to deformation easily.

To achieve the above and other objects, the sectional lighting fixture structure of the present invention includes a hollow main body, an end cap connected to and closing a rear open end of the main body, a socket connected to an inner side of a front open end of the main body for a bulb to mount thereto, and a lighting lampshade externally connected to the front open end of the main body. The sectional lighting fixture structure is characterized in that the main body is a lightweight metal cylindrical body having been subjected to expansion process to include two straight walls at the front and rear ends, and a middle portion having a plurality of bellow expansion joints that provides good pressure resistance. The socket is in the form of a heat-resistant insulating hood, so that heat produced by the bulb mounted thereto is not transmitted to the main body to adversely affect a normal temperature of a ballast mounted in the main body.

With the above arrangements, the sectional lighting fixture structure of the present invention is easy to assemble and includes a lightweight main body made of a thin metal material and subjected to expansion process to provide good heat resistance and heat radiating ability as well as high pressure strength.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
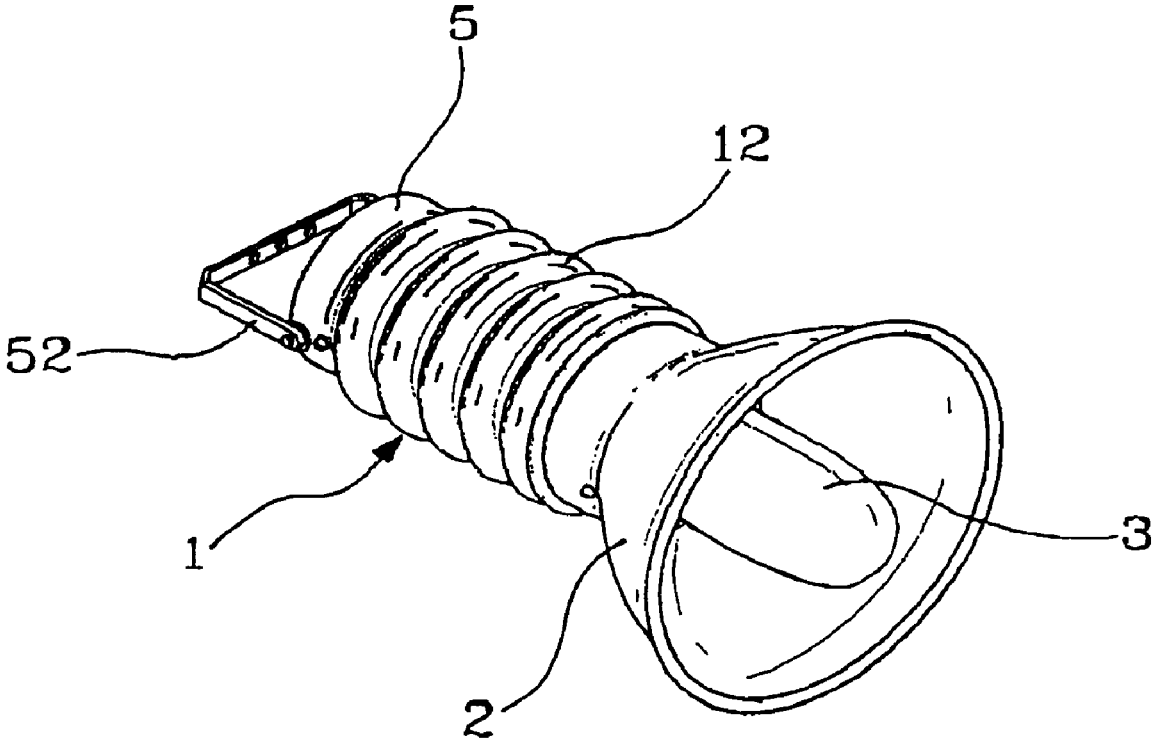
FIG. 1 is an assembled perspective view of a sectional lighting fixture structure according to a preferred embodiment of the present invention.
Figure 2:
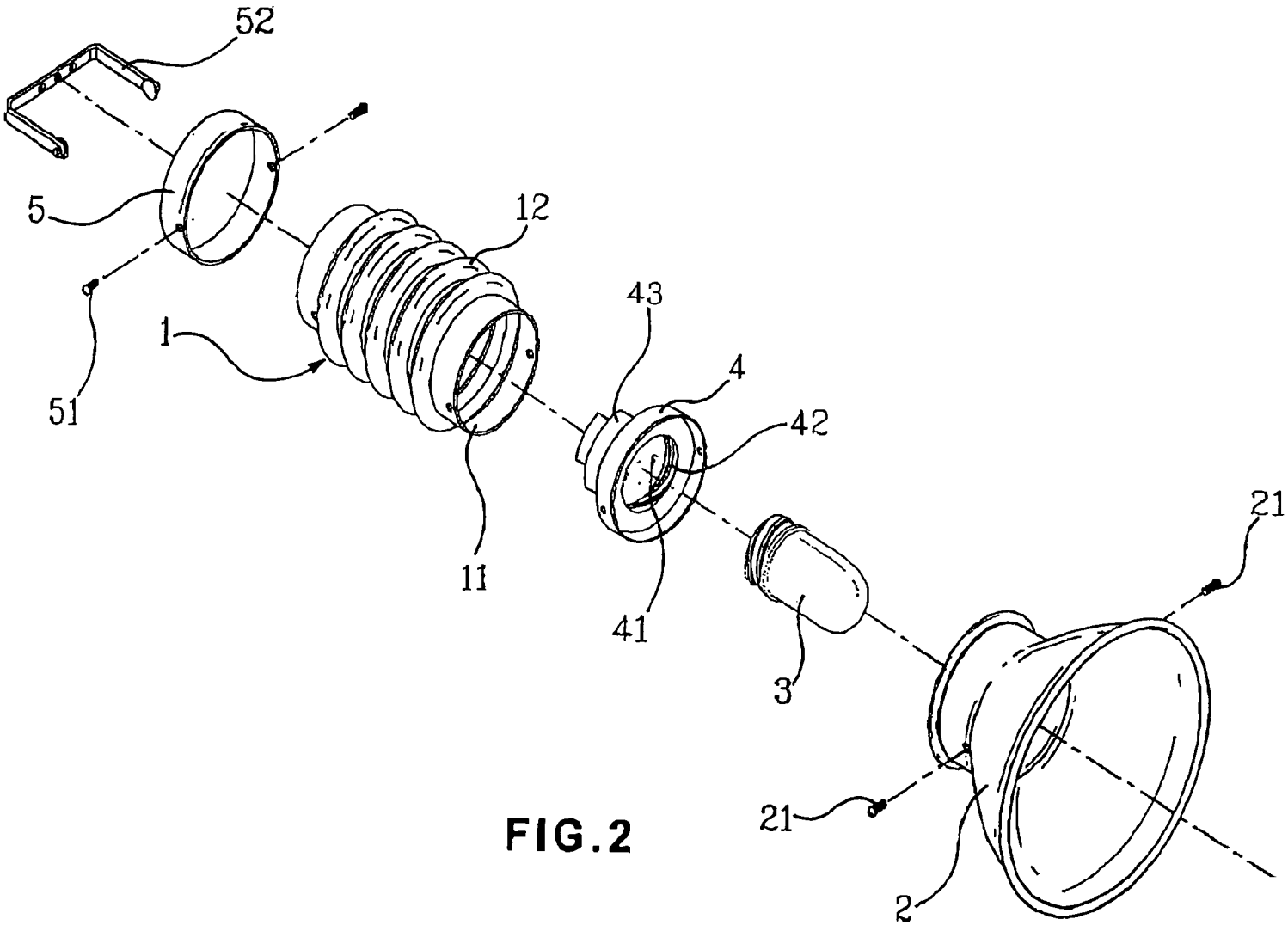
FIG. 2 is an exploded perspective view of the sectional lighting fixture structure of FIG. 1.
Figure 3:
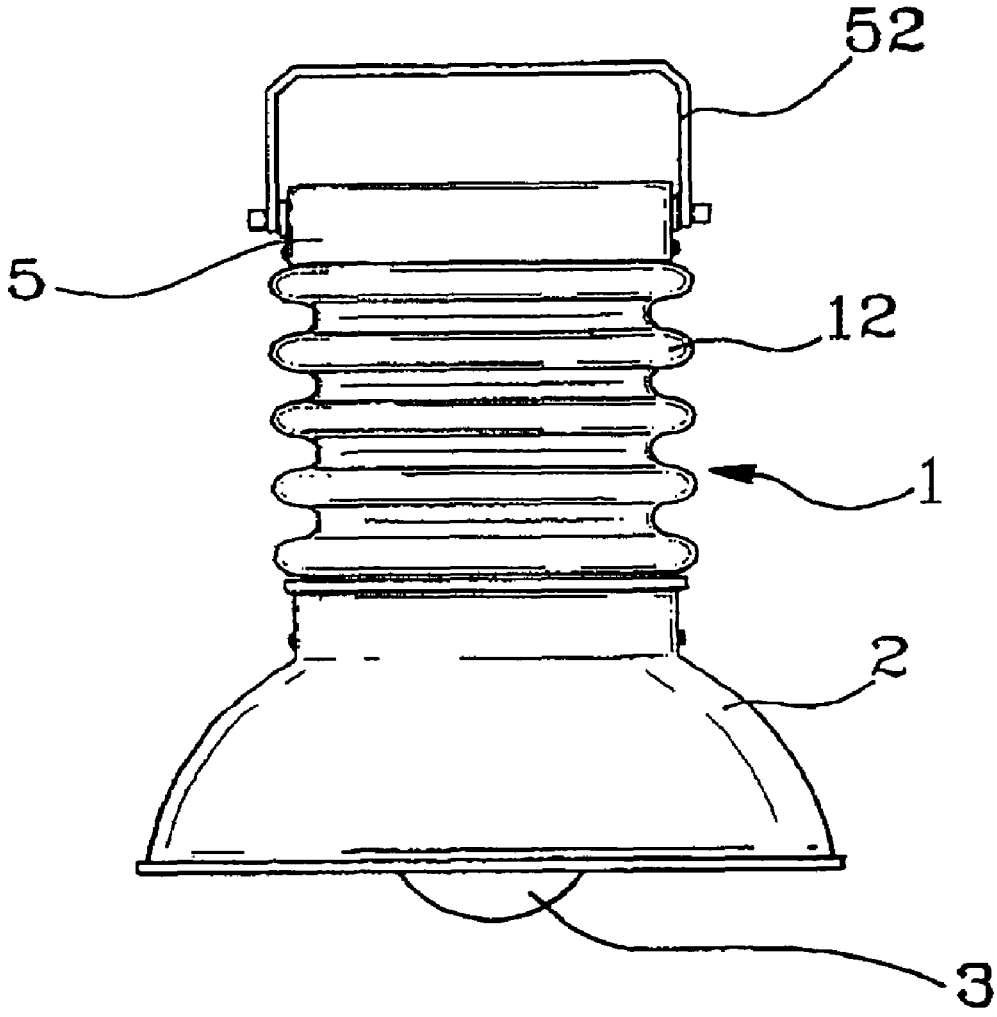
FIG. 3 is a side view of the sectional lighting fixture structure of FIG. 1.
Figure 4:
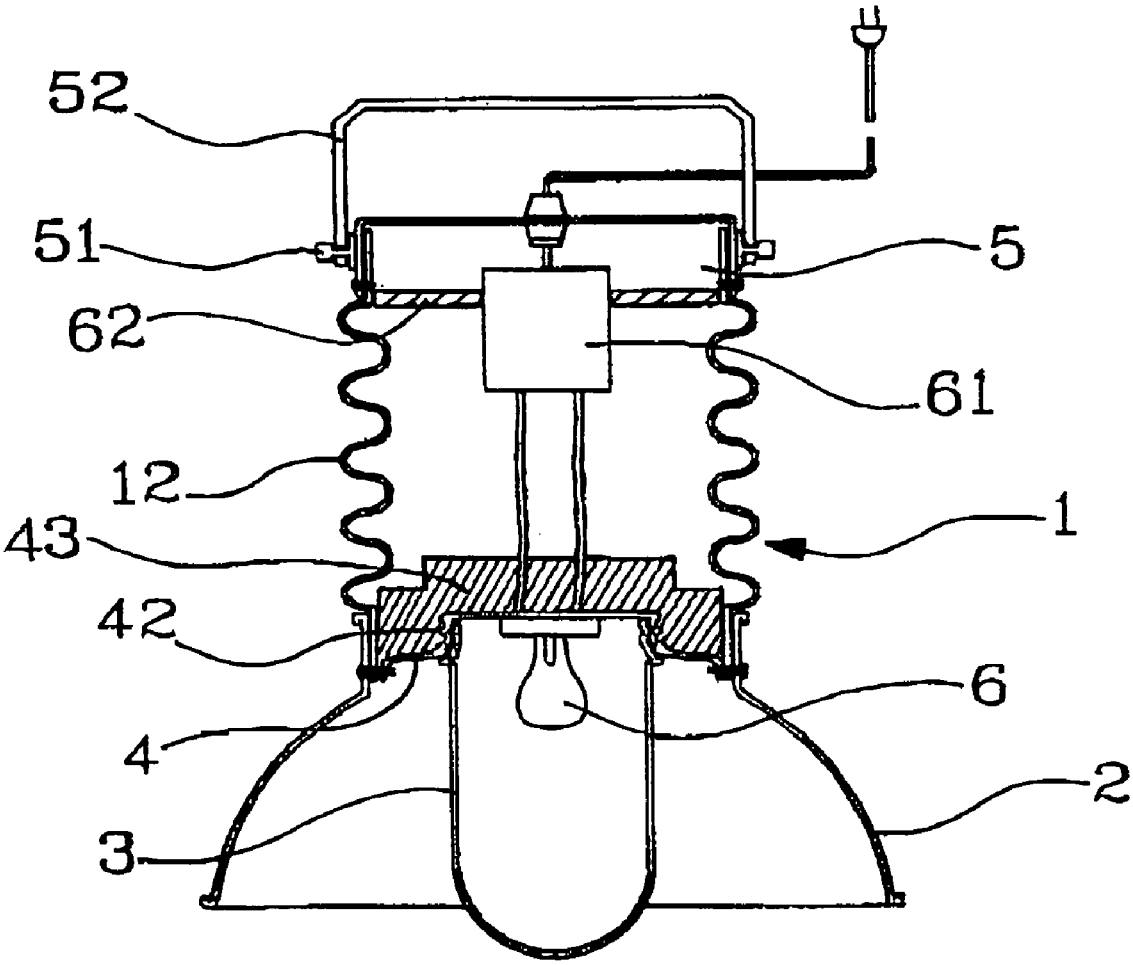
FIG. 4 is an assembled sectional view of the sectional lighting fixture structure of FIG. 1.
Figure 5:
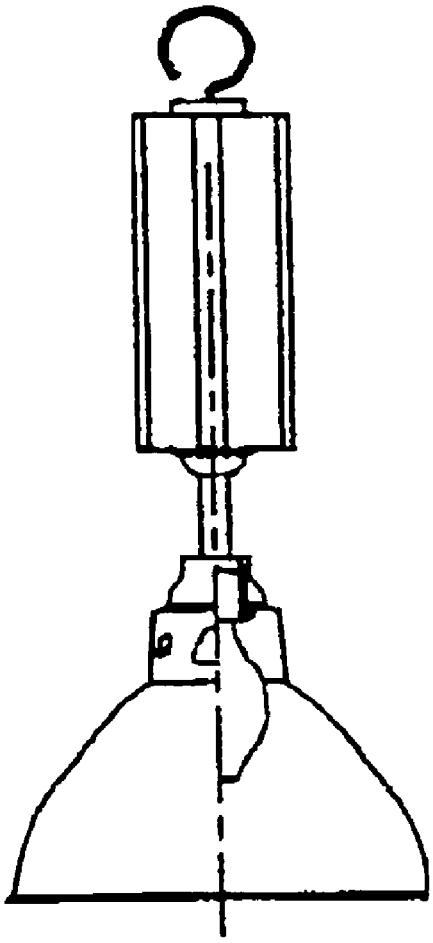
FIG. 5 is a plan view of a conventional lighting fixture structure.
Figure 6:
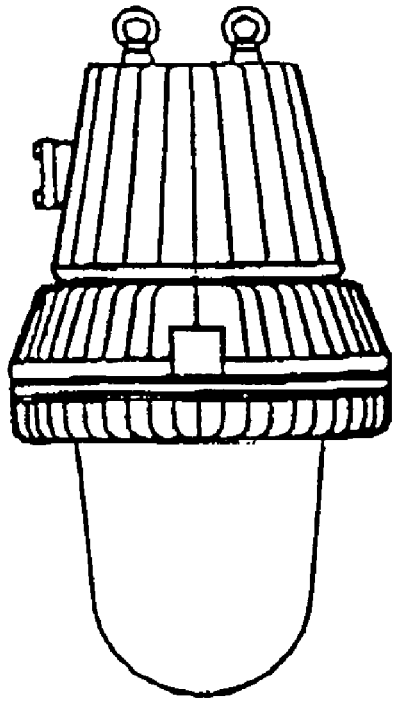
FIG. 6 is a plan view of another conventional lighting fixture structure.

Please refer to FIGS. 1 to 4 in which a lighting fixture structure according to a preferred embodiment of the present invention is shown. The lighting fixture structure of the present invention is a sectional lighting fixture including a hollow main body 1 having an end cap 5 connected to a rear end thereof, a socket 4 located in a front end thereof for a bulb 6 to mount thereto, and a lighting lampshade 2 externally connected to the front end of the main body 1. The sectional lighting fixture structure of the present invention is characterized in that the main body 1 is a metal cylindrical body having been subjected to expansion process, so that it has two opposite open ends having straight walls 11 and a middle portion including a plurality of bellow expansion joints 12. In implementing the present invention, the metal cylindrical main body 1 may be machined to include a plurality of vents. In this manner, the lighting fixture may be made of a thin sheet metal material to enable reduced material, easy assembling, largely reduced weight, good heat resistance, and good heat radiation thereof. With the bellow expansion joints 12, the metal main body 1 also provides very good pressure resistance.

While the straight wall 11 at the rear open end of the main body 1 has the end cap 5 connected thereto, the straight wall 11 at the front open end of the main body 1 is connected to the lighting lampshade 2. A ballast 61 and a plastic frame 62 are received in the hollow main body 1. The ballast 61 is fixed to a center of the plastic frame 62 to thereby fixedly mount in the main body 1.

The lighting lampshade 2 includes an upper cylindrical portion having a thin wall, and a lower semispherical portion having a thin shell integrally extended from the upper cylindrical portion. The lighting lampshade 2 is firmly connected at the upper cylindrical portion to an outer surface of the front straight wall 11 of the main body 1 by means of screws 21.

The end cap 5 is a thin and shallow round cover defining an open end, so that the end cap 5 may be fully closed onto the straight wall 11 at the rear open end of the main body 1, and firmly connected to the main body 1 by means of screws 51. With the lighting lampshade 2 and the end cap 5 connected to the front and the rear open end of the main body 1, respectively, the ballast 61 and the plastic frame 62 may be invisibly received in the hollow main body 1, allowing the lighting fixture structure to have an orderly and beautiful appearance, and be easily operated. A hanger 52 is optionally connected to the end cap 5 to locate above a closed end of the end cap 5, so that the sectional lighting fixture structure may be conveniently portable.

The socket 4 is a rearward projected body defining a centered front recess 41 for a bulb 6 to mount therein. The rearward projected body of the socket 4 is formed into a thermally insulating hood 43 that is highly heat-resistant. With the insulating hood 43, heat produced by the bulb 6 is not transmitted via the socket 4 to the hollow main body 1 to adversely affect the normal temperature of the ballast 61 inside the metal main body 1. In implementing the present invention, the insulating hood 43 is internally filled with a heat-resistant material, such as ceramic insulating wool, glass fiber wool, etc. The socket 4 is connected at a front end to the lampshade 2 via the screws 21, too. The central front recess 41 of the socket 4 is provided at an inner circumferential surface with screw threads 42, with which a bullet-shaped and open-topped glass shell 3 is engaged to protect the bulb 6 located in the shell 3.

To manufacture the sectional lighting fixture structure of the present invention, a heterogeneous material or a non-welding joining technique, or even a liquid deformation technique is employed on a sheet metal material or sheet alloy material, so as to form a primary lighting fixture body having a predetermined shape. The primary lighting fixture body is then subjected to combined forming process, including bending and drum belly forming, so that a plurality of bellow expansion joints 12 are formed on the primary lighting fixture body to give the latter a wave-shaped surface. Other related components, including the end cap 5, the socket 4, the bulb 6, and the lighting lampshade 2, are then assembled to the wave-shaped lighting fixture body to complete a lighting fixture main body with high pressure resistance, low weight, good heat resistance, and good heat radiating ability.

For example, the sheet metal material may be a stainless steel sheet having a thickness within the range from 0.5 mm to 1.2 mm. A plurality of the stainless steel sheets are electrically welded to form a cylindrical steel tube, which is subjected to different processes, such as bending and drum belly forming, so that a plurality of bellow expansion joints are formed on the cylindrical steel tube, giving the latter a wave-shaped appearance. After other related components are assembled to the wave-shaped cylindrical steel tube, a sectional lighting fixture structure is completed.

The sectional lighting fixture structure of the present invention is simple to allow easy assembling thereof. Although the completed main body of the lighting fixture structure has a small wall thickness, the bellow expansion joints 12 formed thereon give it a surface pressure strength higher than 10 kg/cm$^2$ and prevent it from easy deformation. The thin wall of the main body 1 also allows the whole lighting fixture structure to have a largely reduced overall weight, which is only about two thirds of the weight of a conventional lighting fixture having a similar volume. Moreover, the lighting fixture structure may be made of a metal material having good heat resistance and heat radiating ability. With these advantages, the sectional lighting fixture structure of the present invention is obviously superior to the conventional lighting fixtures.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A sectional lighting fixture structure, comprising a hollow main body having a rear and a front end, an end cap connected to the rear end of said main body, a socket located in the front end of said main body for a bulb to mount thereto, and a lighting lampshade externally connected to the front end of said main body;

wherein said main body is a rigid metal cylindrical body having straight walls at the rear and front ends and a wave-shaped middle portion having a plurality of bellows formed thereon such that the main body is resistant to pressure and deformation.

2. The sectional lighting fixture structure as claimed in claim 1, wherein said main body is a hollow metal cylindrical body having a small wall thickness, and the rear and front ends thereof are two opposite open ends; said lighting lampshade including an upper cylindrical portion having a thin wall, and a lower semispherical portion having a thin shell integrally extended from said upper cylindrical portion, and said lighting lampshade being firmly connected at said upper cylindrical portion to an outer surface of said straight wall at the front open end of said main body by means of screws or another method; and said end cap being a thin and shallow round cover defining an open end, so that said end cap is configured to be fully closed onto said straight wall at the rear open end of said main body and be firmly connected thereto by means of screws or another method.

3. The sectional lighting fixture structure as claimed in claim 2, further comprising a hanger connected to said end cap to locate above a closed end of said end cap.

4. The sectional lighting fixture structure as claimed in claim 1, wherein said socket includes a rearward projected body formed into a thermally insulating hood that is highly heat-resistant, such that heat produced by said bulb mounted in said socket is not transmitted via said socket to said hollow main body to adversely affect a normal temperature of a ballast mounted in said metal main body.

* * * * *